United States Patent [19]

Cerny

[11] Patent Number: 4,498,555

[45] Date of Patent: Feb. 12, 1985

[54] HEARING AID NUBBIN AND ACOUSTIC DAMPER

[75] Inventor: Elmer J. Cerny, Des Plaines, Ill.

[73] Assignee: Beltone Electronics Corporation, Chicago, Ill.

[21] Appl. No.: 480,411

[22] Filed: Mar. 30, 1983

[51] Int. Cl.[3] ..... H04R 25/02

[52] U.S. Cl. ..... 181/129; 179/107 H

[58] Field of Search ..... 181/129, 130, 135; 179/107 E, 107 H, 182 R, 180; 128/152

[56] References Cited

U.S. PATENT DOCUMENTS 4,296,829 10/1981 Pedersen ..... 181/129

*Primary Examiner*—L. T. Hix

*Assistant Examiner*—Brian W. Brown

*Attorney, Agent, or Firm*—Allegretti, Newitt, Witcoff & McAndrews, Ltd.

[57] ABSTRACT

An improved nubbin and acoustic damper for the elimination or production of resonance in the sound transmission tubing of a hearing aid. The nubbin and nubbin sound conduit include a right angle corner. The damper comprises a plug having three body portions: a plug portion that is insertable into the conduit, a longer diameter block attached to the plug portion and forming a shoulder therewith that limits movement of the damper into the nubbin, and a plate attached to the block and being of greater diameter than the block. The damper has parallel grooves for sound transmission in its outer surface, with the grooves longitudinally and continuously through the plug portion, block and plate.

15 Claims, 6 Drawing Figures

HEARING AID NUBBIN AND ACOUSTIC DAMPER

BACKGROUND OF THE INVENTION

This invention relates to the field of hearing aids, and more specifically, to hearing aid nubbins and acoustic dampers for eliminating resonance and improving tonal qualities in the transmission of sound between the ear and an amplifier of a hearing aid.

Many people rely upon electronic hearing aids in which sound is received by a microphone and electronically amplified to an increased volume. The amplified sound is then directed to the ear, often through a hollow sound transmission tube. Such a tube normally comprises a flexible and pliable conduit, often constructed of plastic, the hollow center of which acts as an acoustically insulated guide to direct sound vibrations from the amplifier to the ear. This is an especially common arrangement for "behind the ear," "eyeglass frame," and "in the ear" hearing aids. The sound transmission tubing provides an effective yet simple means of transmitting high quality sound to the ear.

Hearing aids of the kind described above generally have six elements: a microphone; an amplifier; a receiver; a case for the foregoing; an earpiece; and a sound transmission tube as described, between the receiver and earpiece. Additionally, hearing aids of eyeglass frame type often have a piece for intersecting and supporting the sound transmission tube known as a "nubbin." Hearing aids of behind the ear type often have a "hook," similar to a nubbin. The nubbin or hook, generically called a sound outlet port is intended to provide a precisely constructed and insulated sound channel, from one internal portion of the sound transmission tube within the case, to another, external, portion of the sound transmission tube. It also is intended to provide support upon the case than minimizes extraneous noise such as vibration.

Performance of such a hearing aid system can be drastically reduced by the presence of resonance in the nubbin or hook and sound transmission tubing. Resonance—the occurence of fixed or standing sound waves in the tubing at specific frequencies—produces distorted sound and unnatural tonal qualities. Resonance can occur at a variety of sound frequencies and result from many different sources. Hearing aids are therefore often designed to minimize resonance in the nubbin or hook and sound transmission tubing by "breaking up" or splitting the sound waves, usually by placing an obstacle such as a plug inside the tubing. Such an element mutes the distorted sound from resonance by disrupting the flow of sound waves in the tubing, thereby preventing the build-up of resonant waves. Blocking plugs or other elements in the sound concuit are referred to as "dampers," due to their ability to dampen or mute the distortion and tonal modification created by resonance.

The structure of nubbins or hooks includes several features that make them appropriate locations for dampers. Nubbins are often designed to include an interface with the sound tubing comprising a tubular protuberance with a head portion adapted to allow flexible tubing to be easily attached to the nubbin by stretching the sound tube end slightly over the protuberance. The sound channel within the nubbin extends from the end of the protuberance. A damper placed in a nubbin may be constructed of a plug with grooves in its sides. A damper like this is shown in U.S. Pat. No. 4,296,829.

The plug breaks up the flow of sound waves, thereby preventing the formation of resonant waves, while the grooves allow the sound to flow past the damper to the sound transmission tubing, and eventually to the ear. A prior art grooved damper therefore consists of a plug sized to slip within a nubbin, and containing several external grooves running longitudinally along the plug surface, parallel to the nubbin sound conduit, and arranged radially about the plug sides. While useful, this damper has drawbacks. First, removal of the damper for replacement or cleaning requires disassembly of the nubbin from the case. Additionally, removal of the damper with the fingers is difficult or impossible because its small size, sung fit and location within the nubbin provide nothing for the fingers to grasp. The damper can only be removed from the nubbin after disassembly of the hearing aid case, and then only be inserting a flexible rod or wire into the opposite end of the nubbin to push the damper out. For replacement or cleaning of the damper, the nubbin must be shaped to allow insertion of the rod or wire.

SUMMARY OF THE INVENTION

Accordingly, an object of this invention is to provide an improved nubbin and acoustic damper to ameliorate the sound transmitted through a tubular hearing aid sound channel to an ear.

A further object of this invention is to provide a nubbin and an acoustic damper such that the damper is capable of easy removal from the nubbin without disassembly of the nubbin from the case.

Another object of this invention is to provide an improved acoustic damper that may be removed from a nubbin, or more specifically, the sound outlet port of a nubbin, hook or other hearing aid structure, with fingers or simple hand tools.

Yet another object of this invention is to provide a nubbin and damper assembly that provides improved tonal qualities and simple removal of the damper.

These and other objects of the invention are achieved by providing a hearing aid nubbin with a hollow sound conduit, and an acoustic damper that is slidably mateable with the hollow sound conduit. The damper comprises a plug having three body portions: a plug portion that is insertable into the conduit, a larger diameter block attached to the plug portion and forming a shoulder therewith that limits movement of the damper into the nubbin, and a plate of greater diameter than the block, which plate is attached to the block. The plate functions as a knob that may be grasped between the fingers for removal of the damper from the nubbin. The plug portion, block and plate are best constructed of a single, uniform mass of material. The damper has parallel grooves for sound transmission in its outer surface running longitudinally and continuously through the plug portion, block and plate.

BRIEF DESCRIPTION OF THE DRAWINGS

The following is a brief description of the drawings showing a preferred embodiment of the invention, wherein like numerals refer to like elements.

DETAILED DESCRIPTION OF THE PREFERRED EMBODIMENT

Figure 1:
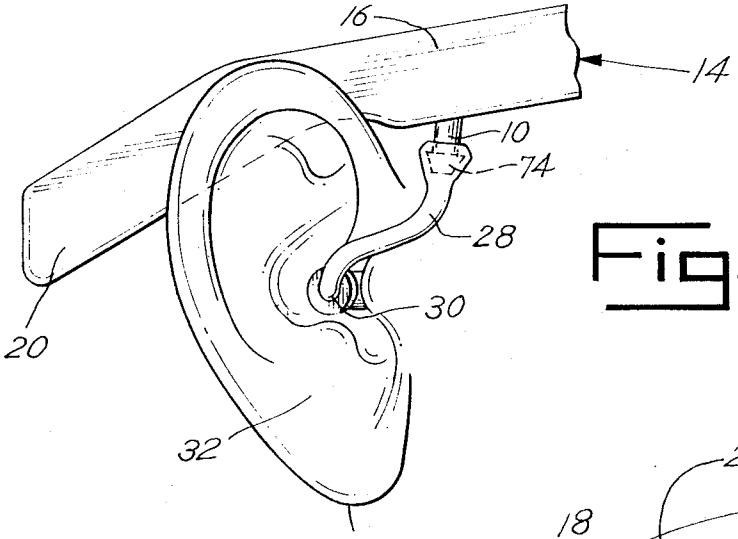
FIG. 1 is a pictoral representation of an ear, showing the hearing aid case, nubbin protuberance, damper and external sound transmission tubing of the preferred eyeglass type hearing aid.
Figure 2:
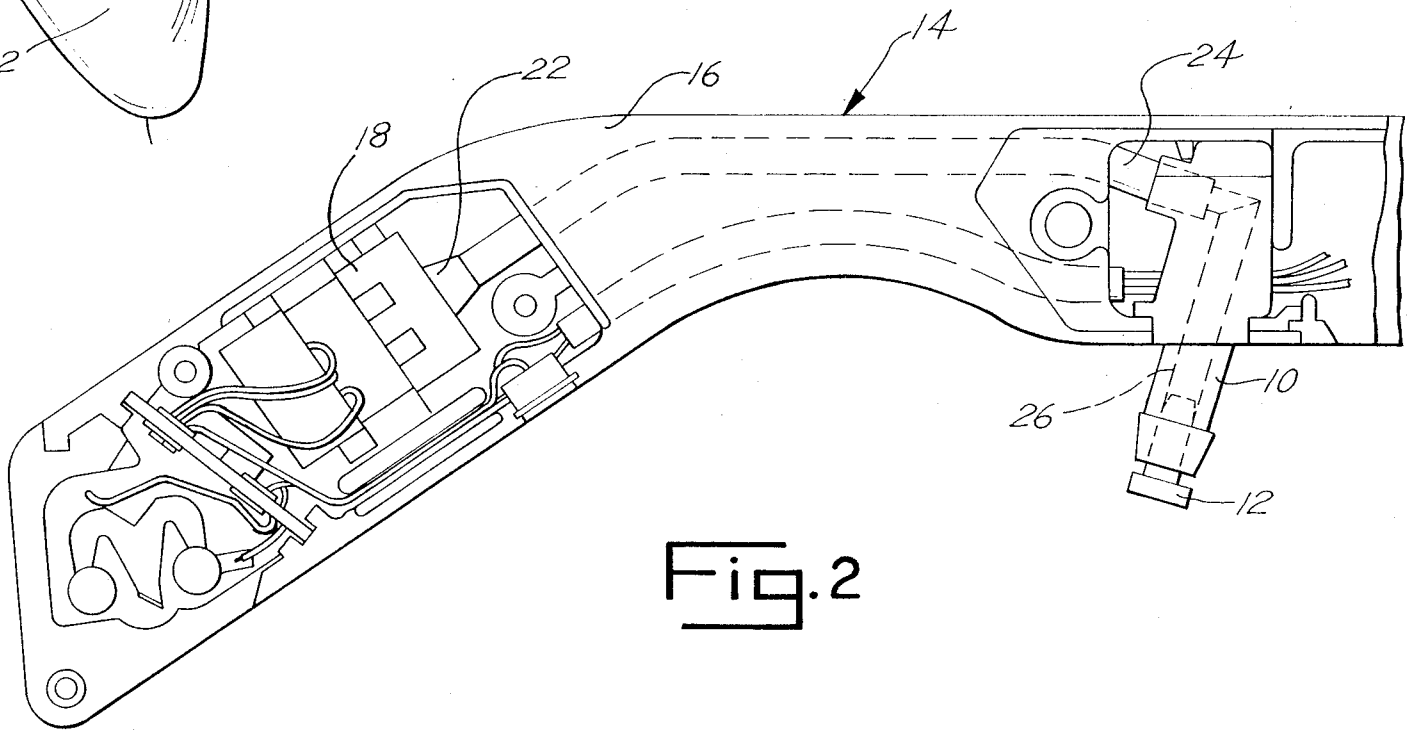
FIG. 2 is a cut-away side view of the hearing aid case, showing the case, receiver, nubbin, damper and internal sound transmission tubing.

As shown in FIGS. 1 and 2, a preferred nubbin 10 and a preferred damper 12 are used in a preferred eyeglass frame hearing aid 14. An eyeglass frame 16 acts as a case for the hearing aid 14. As shown, the receiver apparatus 18 is mounted within the thick rear portion 20 of the frame or case 16. The output 22 of the receiver 18 connects to an internal sound transmission tube 24 leading to the nubbin 10. Sound travels through the tube 24 from the output 22 to the nubbin 10. The amplified sound then passes through a nubbin sound conduit 26, until it reaches the damper 12. The sound next moves past the damper 12, where it is muted, and then passes through an external sound transmission tube 28 to the earpiece 30, which is inserted into the ear 32.

Figure 4:
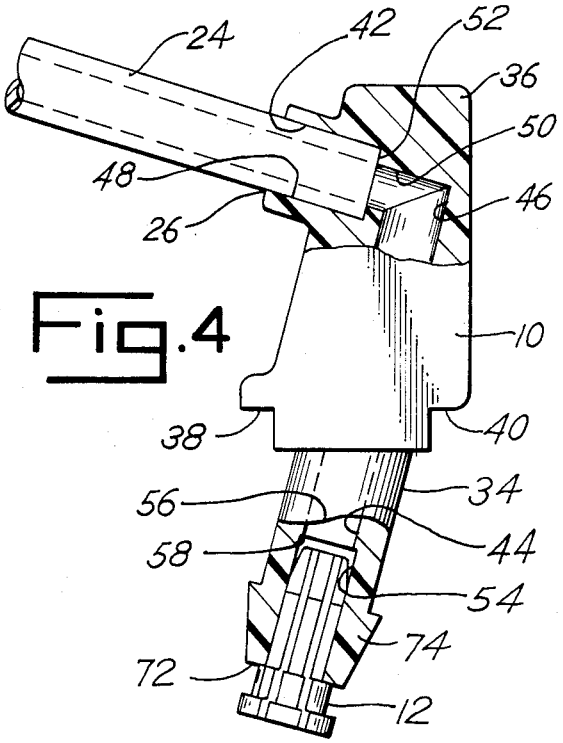
FIG. 4 is a cut-away side view of the preferred nubbin with the preferred acoustic damper and internal sound transmission tubing inserted therein.

FIGS. 2 and 4 show the detail of the nubbin 10. The nubbin 10 and nubbin sound conduit 26 include a right-angle corner. A protruding portion 34 of the nubbin extends from the eyeglass frame 16. An encased portion 36 of the nubbin extends within the frame 16. Adjacent the bottom edge of the frame 16, the encased portion 36 of the nubbin 10 has opposed ledges 38, 40 for supporting the nubbin 10 in the frame 16.

Both the encased portion 36 and the protruding portion 34 of the nubbin are hollow. Both portions 34, 36 define the conduit 26, which includes a receiver-side portion 42 and an intersecting damper-side portion 44. The sidewall 46 of the damper-side portion 44 presents a wall in the path of sound travel through the nubbin 10, where sound waves exit the receiver-side portion 42. After the waves strike the sidewall 46, they are redirected down the portion 44.

The conduit portions 42, 44 are both stepped. That is, the cross-sectional areas of the portions 42, 44 change abruptly. The conduit portion 42 includes an outer, tube receiving segment 48 and an inner, reduced diameter segment 50. The segment 48 tapers toward the segment 50, progressively decreasing in cross-sectional area in the direction away from the receiver 18. The segment 50 is substantially uniform in cross section. A step 52 separates the segments 48, 50.

The conduit portion 44 includes an outer, damper-receiving segment 54 and an inner, reduced diameter segment 56. The segments 54, 56 are substantially uniform in cross section. The segment 54 is uniform to within two-ten thousandths of an inch. The segment 56, while substantially uniform, is tapered three thousandths of an inch, for removal of the nubbin 10 from a molding pin. A step 58 separates the segments 54, 56.

Between the internal tube 24 and the damper 12, the nubbin sound conduit 26 is unobstructed. No piece is inserted to affect sound transmission.

Figure 3:
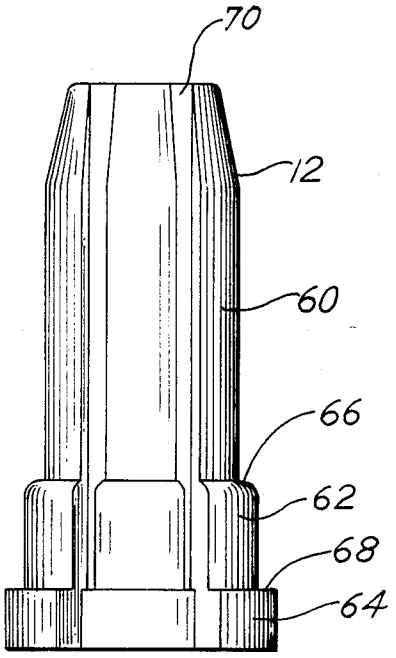
FIG. 3 is a perspective view of the preferred acoustic damper.

FIG. 3 shows the detail of the damper 12. The damper comprises three primary elements: a plug portion 60, a block 62 and a flange plate 64. As illustrated, the flange plate 64 has a greater diameter than the block 62, which in turn has a greater diameter than the plug portion 60. The connection between the plug potion 60 and block 62 creates a positioning shoulder 66, and the connection between the block 62 and the flange plate 64 creates a second shoulder 68.

Figure 5:
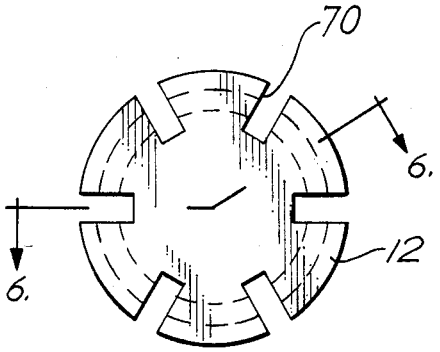
FIG. 5 is a top view of the acoustic damper showing the preferred groove configuration.
Figure 6:
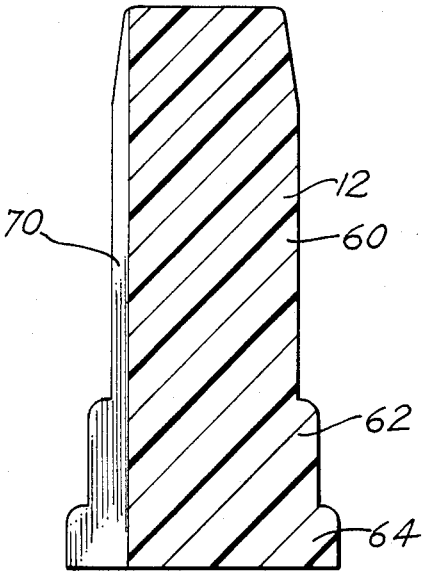
FIG. 6 is a side cross-sectional view of the acoustic damper.

Referring now to both FIG. 3 and FIG. 5, the damper 12 has a series of grooves 70, each of which extends in an unbroken, continuous path longitudinally down the length of the damper 12. As shown in FIG. 6, the grooves 70 preferably comprise rectangular slots positioned at opposite points radially around the outer surface of the damper 12.

As shown in FIG. 4, when the damper 12 is inserted in the sound conduit 26 of the nubbin 10, the positioning shoulder 66 rests against the lower face 72 of the nubbin 10, thereby restricting the extent to which the damper 12 may be inserted in the nubbin 10. The block 62 then positions the flange plate 64 away from the nubbin lower face 72. Removal of the damper 12 from the nubbin 10 is easily accomplished by simply grasping and pulling on flange plate 64, with fingers or small pliers, and exerting pressure against the second shoulder 68.

FIG. 1 also illustrates the connection of the external sound transmission tube 28 to the nubbin 10. As shown, the nubbin 10 preferably has a tapered lower end 74, over which the sound transmission tube 28 may be slipped. The sound transmission tube 28 also slips over the flange plate 62 of the damper 12. The grooves 70 then allow sound to travel from the nubbin sound channel 26 to the sound transmission tube 28, while the damper 12 prevents formation of resonant waves.

FIG. 6 illustrates some additional features of the damper 12. In the preferred embodiment, the grooves 70 extend longitudinally along the length of the damper 12 in an unbroken, unbending and continuous line. Additionally, the damper 12 has a tapered end 76 on the plug end 60 of the damper 12. The damper 12 is then easily inserted into the nubbin sound conduit 26 until the positioning shoulder 66 prevents further insertion.

The specific embodiment of the nubbin and damper illustrated is only one of a number of embodiments that may be employed to utilize the invention. For example, the damper 12 may be placed as described in the hook of a behind-the-ear hearing aid. Therefore, to particularly point out and distinctly claim the subject matter regarded as invention, the following claims conclude this specification.

What is claimed is:

1. A hearing aid nubbin and acoustic damper, the nubbin including a hollow portion with an internal surface, the acoustic damper including, a plug having a plurality of grooves, the plug mateable with the internal surface of the hollow portion of the nubbin;

a block, affixed to the plug and forming a shoulder between the block and plug, the block having grooves aligned and continuous with the plug grooves; and a plate, affixed to the block and forming a shoulder between the plate and block, the plate having grooves aligned and continuous with the plug and block grooves, whereby sound may be transmitted along the grooves, the block shoulder may limit the extent of insertion into the nubbin, and the plate shoulder may function as a graspable flange for removal of the damper from the nubbin.

2. A hearing aid nubbin and acoustic damper as in claim 1 in which the hollow portion of the nubbin includes a protruding portion and defines a nubbin sound conduit, the conduit including a damper-receiving portion of substantially uniform cross-section.

3. A hearing aid nubbin and acoustic damper as in claim 1 in which the hollow portion and nubbin sound conduit of the nubbin include a right angle corner.

4. A hearing aid nubbin and acoustic damper as claimed in claim 1, wherein the grooves of the plug, block and plate cooperatively define sound transmission grooves and the sound transmission grooves comprise substantially parallel slots in the damper outer surface extending longitudinally along an axis through the centers of the plug, block and plate.

5. A hearing aid nubbin and acoustic damper as claimed in claim 1, wherein the plate is sized to be graspable with fingers or pliers.

6. A hearing aid nubbin and acoustic damper as claimed in claim 1, wherein the plug, block and plate comprise a single, jointless body of substantially uniform material.

7. An acoustic damper for insertion in a hearing aid sound component outlet port having an interior surface and sound channel, comprising, in combination:

a plug, mateable with the outlet port interior surface;

means for allowing passage of sound past the plug and along the outlet port sound channel;

means for restricting the extent of insertion of the plug into the outlet port sound channel; and an extension interconnected to the plug, whereby the extension may be grasped for removal of the plug from the port.

8. An acoustical damper for reducing resonance in a hearing aid sound transmission channel and mateable with a hollow hearing aid port, comprising:

a substantially cylindrical damper body having three differently sized body portions, with a first portion slidably insertable longitudinally into the port, the damper body defining two shoulders and having a plurality of grooves continuous along the body outside surface and substantially parallel to the body longitudinal axis, the first shoulder separating a greater diameter second portion of the body from the lesser diameter first portion, the first shoulder also limiting insertion of the body into the port, the second shoulder separating the third body portion from the second body portion, the third portion having a body diameter greater than the second portion, whereby the third body portion may be manually grasped at the second shoulder for easy removal of the damper from the port.

9. An acoustical damper as claimed in claim 8 wherein the damper is retained within the port by a snug friction fit, whereby the port may be moved into a variety of positions without dislodging the damper.

10. An acoustical damper for a hearing aid of the kind having tubing as a sound conductor between the hearing aid case and the ear, and having a component with a sound outlet port to connect the tubing to the case, the damper comprising:

a plug grooved on its outer surface and having a connection end, a retrieval flange opposite the connection end, and a positioning shoulder between the connection end and retrieval flange, the portion of the plug from the connection end to the positioning shoulder being slidably insertable within the sound outlet port, the grooves being longitudinally continuous along the insert portion and through the connection end, positioning shoulder, and retrieval flange, the positioning shoulder having a diameter greater than the port to limit insertion of the plug into the port, and the retrieval flange extending beyond the diameter of the positioning shoulder whereby sound may be transmitted along the grooves, and the plug may be removed from the nubbin by grasping the retrieval flange with fingers or manually operated tools.

11. An acoustic damper as claimed in claim 10 wherein the connection end of the plug comprises a tapered outer portion whereby the plug may be easily placed within the port.

12. An acoustic damper as claimed in claim 10 wherein the grooves comprise a plurality of opposed slots in the plug's outer surface, extending the length of the plug.

13. An acoustic damper as claimed in claim 10 wherein the positioning shoulder comprises a generally right angled interface between the plug connection end and a wider plug portion between the connection end and retrieval flange.

14. An acoustic damper for reduction of resonance in the hollow sound conduit of a hearing aid nubbin, comprising, in combination:

a plug mateable with the nubbin hollow conduit and forming a snug friction with which the interior surface of the nubbin conduit when inserted therein;

a block having a diameter greater than the plug, and affixed to the plug forming a first shoulder therebetween;

a plate having a greater diameter than the block and affixed threto opposite the plug forming a graspable second shoulder between the plate and block, the plate being sized for manual grasping with fingers or hand tools; and a plurality of continuous, parallel, opposed grooves extending longitudinally along the outer surface of the damper and comprising slots in the damper surface, whereby the plug and block disrupt the flow of sound waves to prevent resonance, the grooves allow transmission of sound past the damper, the first shoulder limits insertion of the damper into the nubbin, and the second shoulder may be used as a graspable flange to allow manual removal of the damper from the nubbin.

15. An acoustic damper as claimed in claim 14 wherein the plug, block and plate comprise a single, jointless, substantially uniform material.

* * * * *